US006565132B2

(12) United States Patent
Mork et al.

(10) Patent No.: US 6,565,132 B2
(45) Date of Patent: May 20, 2003

(54) VEHICLE COMPARTMENT LATCH

(75) Inventors: Neil E. Mork, Armada, MI (US); Brian Roberts, Royal Oak, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/894,295

(22) Filed: Jun. 28, 2001

(65) Prior Publication Data

US 2003/0001397 A1 Jan. 2, 2003

(51) Int. Cl.[7] ..... E05C 3/16
(52) U.S. Cl. ..... 292/216; 293/201; 293/DIG. 43
(58) Field of Search ..... 292/216, 201, 292/DIG. 43; 49/229, 280; 70/237, 264

(56) References Cited

U.S. PATENT DOCUMENTS 5,020,838 A * 6/1991 Fukumoto ..... 292/201
5,921,594 A 7/1999 Bendel
5,934,717 A * 8/1999 Wirths et al. ..... 292/201
6,076,868 A 6/2000 Rogers, Jr. et al.
6,109,671 A * 8/2000 Roncin et al. ..... 292/201

* cited by examiner

*Primary Examiner*—J. J. Swann
*Assistant Examiner*—Dinesh N Melwani
(74) *Attorney, Agent, or Firm*—Kathryn A. Marra

(57) ABSTRACT

A vehicle closure has a power operated vehicle compartment latch that includes a fork bolt, a detent lever having a release tab and a stop tab, and an eccentric post on an electric motor driven wheel. The detent lever is driven to a release position by the motor via the post and the release tab to unlatch the vehicle closure. The post engages the stop tab to stall the electric motor after the detent is driven to the release position which allows the fork bolt to move to an open or unlatch position. The stop tab is disabled when the fork bolt is moved to the latch position.

6 Claims, 2 Drawing Sheets

VEHICLE COMPARTMENT LATCH

TECHNICAL FIELD

This invention relates to a vehicle compartment latch and more particularly to a power operated compartment latch for latching a vehicle compartment closure, such as a trunk deck lid or a cargo lift gate, in the closed position to secure the vehicle compartment.

BACKGROUND OF THE INVENTION

Passenger vehicles are normally equipped with a rear vehicle compartment for storing a spare tire and transporting items such as groceries and luggage. A conventional passenger vehicle has a trunk that is closed by a deck lid that is hinged to the vehicle body and swings open to provide access to the trunk. On the other hand, a passenger van has a rear cargo compartment that is closed by a lift gate. The deck lid or lift gate is usually equipped with a compartment latch that cooperates with a striker attached to the vehicle body to latch the closure (e.g. deck lid or lift gate) in the closed position.

In order to open the vehicle closure, the compartment latch must be unlatched or opened. Nearly all installations include a key lock cylinder or some other means for unlatching the compartment latch manually. However, power operated compartment latches that can be unlatched electrically by a switch inside the passenger compartment or by a key fob are becoming very popular.

In the past, power operated compartment latches have required either a reversible electric motor or a massive return spring to restore the compartment latch to an open position after a power unlatching operation.

U.S. Pat. No. 6,076,868 granted to Lloyd Rogers Jr., et al Jun. 20, 2000 discloses an improved power operated vehicle compartment latch that does not require either a reversible electric motor or a massive return spring.

SUMMARY OF THE INVENTION

This invention provides a still further improved power operated vehicle compartment latch that does not require either a reversible electric motor or a massive return spring to restore the compartment latch to an open position.

The power operated vehicle compartment latch has a support that is adapted for fastening to a closure, a fork bolt that moves between an open position and a closed position, and a detent lever that moves between a detent position and a release position. The detent lever retains the fork bolt in the closed position when in the detent position and releases the fork bolt for return to the open position when in the release position. The detent lever has a release tab and a stop tab. A power unit that is mounted on the support, rotates a wheel that carries an eccentric post that moves in a circular path as the wheel rotates. When the power unit is activated, the eccentric post engages and moves the release tab moving the detent lever to the release position so that the fork bolt can move to the open position. After the detent lever is moved to the release position, the eccentric post engages the stop tab to deactivate the power unit. The stop tab is disabled when the fork bolt and detent lever are moved to the respective closed and detent positions. The vehicle compartment latch is now set for power unlatching.

The power operated vehicle compartment latch is preferably powered by a unidirectional electric motor that is preferably shut off by stalling the electric motor.

The fork bolt and detent lever of the power operated vehicle compartment latch are preferably biased to respective latched and detent positions by a single spring.

These and other features, objects and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
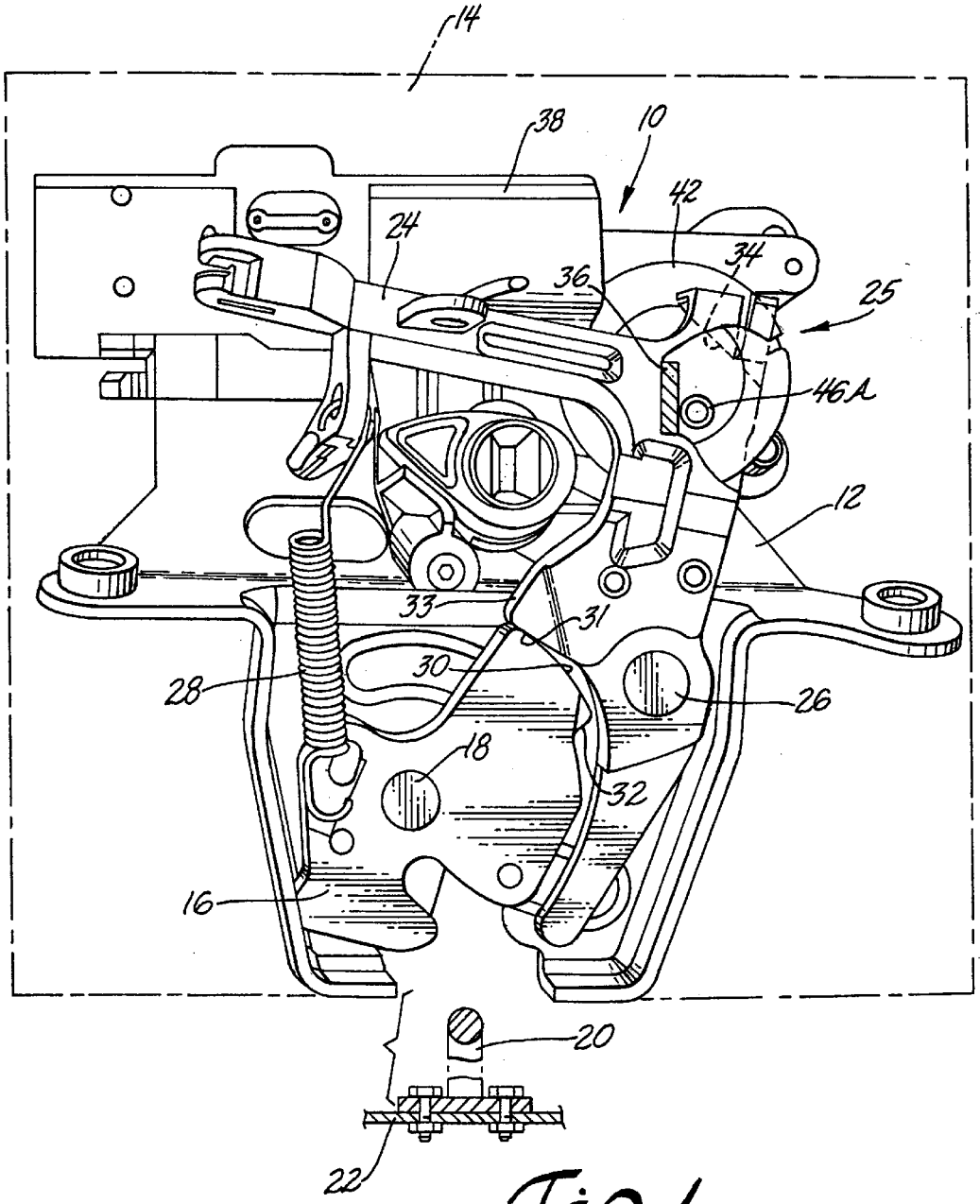
FIG. 1 is a rear view of a vehicle having a closure that is equipped with a vehicle compartment latch of the invention showing the parts of the vehicle compartment latch in the open or unlatched position.
Figure 2:
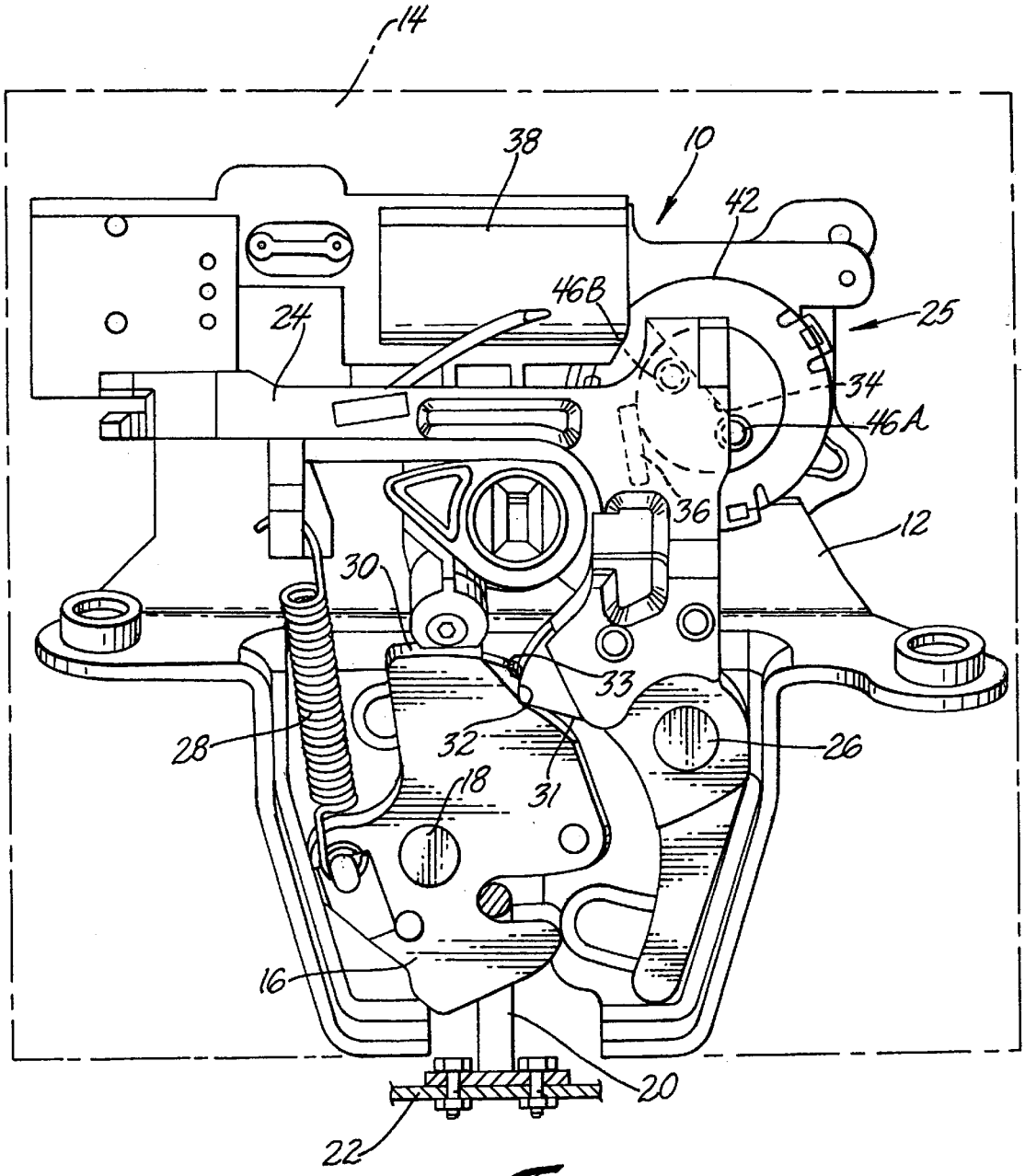
FIG. 2 is a rear view of the vehicle of FIG. 1 showing the parts of the vehicle closure latch in the closed or latched position.

Vehicle compartment latch 10 comprises a housing or support 12 that is adapted for fastening to a vehicle compartment closure, such as a trunk compartment deck lid 14, and a fork bolt 16 that pivots on support 12 about pivot pin 18 between an open or unlatched position shown in FIG. 1 and a closed or latched position shown in FIG. 2. Vehicle compartment latch 10 is attached to deck lid 14 so that fork bolt 16 is moved from the open position shown in FIG. 1 to the closed position shown in FIG. 2 when deck lid 14 is closed and fork bolt 16 engages a striker 20 that is attached to the vehicle body 22 at the deck lid opening. The cooperation of a fork bolt and striker is well known and need not be described in detail.

Vehicle compartment latch 10 further comprises a detent lever 24 that pivots on support 12 about pivot pin 26 and cooperates with fork bolt 16 in a well known manner to retain fork bolt 16 in the closed position shown in FIG. 2 or release the fork bolt 16 for return to the open position shown in FIG. 1. That is, detent lever 24 pivots between a detent position shown in FIG. 2 and a release position shown in FIG. 1. Fork bolt 16 is spring biased clockwise to the open position shown in FIG. 1 by coil spring 28 that has one end attached to fork bolt 16 and the other end attached to detent lever 24. Thus coil spring 28 also spring biases detent lever 24 counterclockwise against face 30 of fork bolt 16 as shown in FIG. 1 and toward the detent position shown in FIG. 2 where detent lever 24 engages latch shoulder 32 of fork bolt 16.

Detent lever 24 includes a release tab 34 and a stop tab 36 that project rearwardly, that is into the plane of the paper as viewed in FIGS. 1 and 2. Release tab 34 and stop tab 36 control the movements of detent lever 24 by a power unit 25 as explained below.

Power unit 25 includes a unidirectional electric motor 38 mounted on support 12 that drives a worm gear (not shown) that in turn drives a gear wheel 42 that rotates on pivot pin 44 of support 12. Gear wheel 42 carries an eccentric post 46 that moves in a concentric circular path as gear wheel 42 rotates on support 12. Post 46 cooperates with release tab 34 and stop tab 36 as explained below.

Vehicle compartment latch 10 operates in the following manner. FIG. 1 shows deck lid 14 open with fork bolt 16 in the open or unlatched position and detent lever 24 in the release position. Post 46 engages stop tab 36. When deck lid 14 is closed, fork bolt 16 engages striker 20 and fork bolt 16 is pivoted counterclockwise by the closing deck lid 14 from the open or unlatched position shown in FIG. 1 to the closed or latched position trapping striker 20 in the compartment latch 10 as shown in FIG. 2. As forkbolt 16 pivots to the closed position face 30 of fork bolt 16 rides along ramp 31 of detent lever 24. When fork bolt 16 reaches the latched position of FIG. 2, detent lever 24 is pivoted counterclockwise by coil spring 28 moving catch surface 33 into engagement with latch shoulder 32. When detent lever 24 pivots to the latched position of FIG. 2, stop tab 36 is moved out of the circular path of travel of post 46. Post 46, however, remains in position A shown in FIGS. 1 and 2. Vehicle compartment latch 10 is now ready for a power release by power unit 25.

Vehicle compartment latch 10 is power released by energizing electric motor 38 which turns gear wheel 42 clockwise so that post 46 travels clockwise in a concentric circular path about pivot pin 44 from position A shown in FIG. 2 to position B by-passing stop tab 36 and into engagement with release tab 34. As gear wheel 42 continues turning, post 46 pushes release tab 34 in a clockwise direction pivoting detent lever 24 clockwise to the release position shown in FIG. 1 where stop tab 36 is moved into the circular path of travel of post 46. Fork bolt 16 is now free to rotate clockwise and deck lid 14 is opened a given amount by the bias of coil spring 28 and the pressure of the deck lid seal (not shown). These opening forces open deck lid 14 enough to withdraw striker 20 so that fork bolt 16 pivots clockwise back to the open or unlatched position shown in FIG. 1 under the bias of coil spring 28. As fork bolt 16 rotates clockwise to the open position of FIG. 1 face 30 slides along ramp 31 to hold detent lever 24 in the release position which moves stop tab 36 back into the circular path of movement of post 46. In the meantime, post 46 continues to travel with gear wheel 34 past release tab 34 and back around to position A engaging stop tab 36 and stalling electric motor 38. The parts are now in the open or unlatched position shown in FIG. 1 and the vehicle compartment latch 10 is ready for latching engagement with striker 20 when deck lid 14 is closed as described above.

While the compartment latch of our invention has been described in connection with deck lid 14, the compartment latch can be used with other compartment closures such as a van lift gate. In other words, many modifications and variations of the present invention in light of the above teachings may be made. It is, therefore, to be understood that, within the scope of the appended claims, the invention may be practiced otherwise than as specifically described.

We claim:

1. A power operated vehicle compartment latch comprising:

a support that is adapted for fastening to a closure, a fork bolt that moves between an open position and a closed position, a detent lever that moves between a detent position and a release position, the detent lever retaining the fork bolt in the closed position when in the detent position and releasing the fork bolt for return to the open position when in the release position, the detent lever having a release tab and a stop tab that is spaced from the release tab, a power unit mounted on the support, the power unit including a wheel that rotates on the support and that carries an eccentric post that moves in a circular path as the wheel rotates, and the release tab being in the circular path of the eccentric post and the stop tab being radially outward of the circular path of the eccentric post when the fork bolt is in the closed position and the detent lever is in the detent position, the eccentric post engaging and moving the release tab to move the detent lever to the release position so that the fork bolt can move to the open position when the wheel is rotated, and the detent lever moving the stop tab into the circular path of the eccentric post when the detent lever is moved to the release position, so that the eccentric post disengages the release tab and then engages the stop tab to stop the wheel.

2. The power operated vehicle compartment latch as defined in claim 1 wherein the fork bolt is biased toward the open position and the detent lever is biased into engagement with the fork bolt so that the fork bolt engages the detent lever and holds the detent lever in the release position after the detent lever is moved to the release position by the eccentric post.

3. A power operated vehicle compartment latch comprising:

a support that is adapted for fastening to a vehicle closure, a fork bolt that pivots on the support between an open position and a closed position, the fork bolt being moved from the open position to the closed position when the closure vehicle is closed, a detent lever that pivots on the support between a detent position and a release position, the detent lever retaining the fork bolt in the closed position when in the detent position and releasing the fork bolt for return to the open position when in the release position, the fork bolt being spring biased to the open position and the detent lever being spring biased to the detent position, so that detent lever rides on a surface of the fork bolt and engages a latch shoulder of the fork bolt when the fork bolt is moved to the closed position, the detent lever having a release tab and a stop tab that is spaced from the release tab, a power unit including an electric motor mounted on the support, a gear wheel that rotates on the support and that is driven by the electric motor, an eccentric post carried by the gear wheel that moves in a circular path as the gear wheel rotates, the release tab being in the circular path of eccentric post and the stop tab being radically outward of the circular path of the eccentric post when the fork bolt is in the closed position and the detent lever is in the detent position, the eccentric post engaging and moving the release tab to move the detent lever to the release position so that the fork bolt can move to the open position when the wheel is rotated, and the detent lever moving the stop tab into the circular path of the eccentric post when the detent lever is moved to the release position so that the eccentric post disengages the release tab and then engages the stop tab to stall the electric motor.

4. The power operated vehicle compartment latch as defined in claim 3 wherein the detent lever rides on the surface of the fork bolt when the fork bolt is moved to the open position so that the detent lever is held in the release position by the fork bolt after the detent lever is moved to the release position by the eccentric post.

5. A power operated vehicle compartment latch comprising:

a support that is adapted for fastening to a vehicle closure, a fork bolt that pivots about a first pivot pin of the support between an open position and a closed position, the fork bolt being moved from the open position to the closed position when the vehicle closure is closed and the fork bolt engages a striker that is attached to the vehicle at the vehicle closure opening, a detent lever that pivots about a second pivot pin of the support between a detent position and a release position, the detent lever retaining the fork bolt in the closed position when in the detent position and releasing the fork bolt for return to the open position when in the release position, a coil spring that is attached to the fork bolt at one end and to the detent lever at the opposite end so that the fork bolt is spring biased to the open position and the detent lever is spring biased to the detent position so that detent lever rides on a surface of the fork bolt and engages a latch shoulder of the fork bolt when the fork bolt is moved to the closed position by closing the vehicle closure, the detent lever having a release tab and a stop tab that is spaced from the release tab, a power unit including a unidirectional electric motor mounted on the support, a gear wheel that rotates on a third pivot pin of the support and that is driven by the unidirectional electric motor, an eccentric post that moves in a concentric circular path about the third pivot pin as the gear wheel rotates on the third pivot pin to cooperate with the release tab to unlatch the vehicle closure latch, the release tab being in the circular path of the eccentric post and the stop tab being radically outward of the circular path of the eccentric post when the fork bolt is in the closed position and the detent lever is in the detent position, the eccentric post engaging and moving the release tab to move the detent lever to the release position so that the fork bolt can move to the open position when the wheel is rotated, and the detent lever moving the stop tab into the circular path of the eccentric post when the detent lever is moved to the release position, so that the eccentric post disengages the release tab and then engages the stop tab to stop the wheel by stalling the unidirectional electric motor.

6. The power operated vehicle compartment latch as defined in claim 5 wherein the detent lever rides on the surface of the fork bolt when the fork bolt is moved to the open position so that the detent lever is held in the release position by the fork bolt after the detent lever is moved to the release position by the eccentric post.

* * * * *